US005470172A

United States Patent [19]

Wiedrich

[11] Patent Number: 5,470,172

[45] Date of Patent: Nov. 28, 1995

[54] MANHOLE ADJUSTING EXTENSION RING SECTION

[76] Inventor: Dwight G. Wiedrich, N-2204 730th St., Hager City, Wis. 54014

[21] Appl. No.: 254,908

[22] Filed: Jun. 6, 1994

[51] Int. Cl.[6] ..... E02D 29/14

[52] U.S. Cl. ..... 404/25; 404/26; 52/20

[58] Field of Search ..... 404/25, 26; 52/19, 52/20, 21

[56] References Cited

U.S. PATENT DOCUMENTS

| | | | |
|---|---|---|---|
| 2,593,918 | 4/1952 | Redman . | |
| 4,187,647 | 2/1980 | Hall | 52/20 |
| 4,188,151 | 2/1980 | Hall | 404/26 |
| 4,236,358 | 12/1980 | Bowman | 52/19 |
| 4,408,421 | 10/1983 | Pai | 52/20 |
| 4,690,584 | 9/1987 | LeBaron | 404/26 |
| 4,834,574 | 5/1989 | Bowman | 404/26 |
| 4,976,568 | 12/1990 | Hess | 404/26 |
| 5,030,030 | 7/1991 | Simmonds | 404/25 |
| 5,051,022 | 9/1991 | Bowman | 404/26 |
| 5,205,668 | 4/1993 | Adams | 404/26 |

FOREIGN PATENT DOCUMENTS

| | | | |
|---|---|---|---|
| 2270708 | 3/1994 | United Kingdom | 404/25 |

*Primary Examiner*—Ramon S. Britts
*Assistant Examiner*—Pamela A. O'Connor
*Attorney, Agent, or Firm*—Haugen and Nikolai

[57] ABSTRACT

A molded plastic extension member for use in increasing the height of manholes, or catch basins when surfacing or resurfacing a roadway is described. A wedge to adjust the angle of the catch basin support frame or the manhole cover support frame is also described. The extension includes a pocket for reducing the total surface area of the molded plastic member. It also includes a shoulder that interlocks with either the manhole cone, the catch basin cone, or with other stackable molded plastic members. The extension also contains a planer support surface which provides rigidity and support, and provides a surface for caulking to be applied to form a watertight seal.

36 Claims, 15 Drawing Sheets

MANHOLE ADJUSTING EXTENSION RING SECTION

BACKGROUND OF THE INVENTION

I. Field of the Invention

This invention relates generally to a manhole and catch basin extension. More particularly, it relates to a plastic extension that may be used to elevate a manhole cover support frame or a catch basin grating support frame, thereby elevating the top surface of a manhole or catch basin to a desired level and angle such that, for example, the level of a newly surfaced or resurfaced roadway and the level of the manhole cover or catch basin grating are the same.

II. Discussion of the Prior Art

It is common practice to construct a manhole in roadways or streets to allow access to underground, sanitary and storm sewers and utility conduits. When a manhole in a roadway is first constructed, it comprises a base with concentric sides extending upward, a cone mounted above the base (usually a monolithic cast), of usually a tubular, conical, or cylindrical structure made of concrete or brick, a cast iron support frame and a cover. The cast iron support frame is positioned above the cone and supports the manhole cover. The concrete manhole structure is built up to an elevation approximately that at which the manhole cover will be at road level. One or more spacers may then be used between the cast iron support frame and cone, to ensure that the cover will be flush with the road surface.

It is also common practice to construct a catch basin along the curb line of roadways or streets to allow surface water drainage into underground storm sewers. The catch basin structure is similar to the manhole structure. The catch basin, when first constructed, comprises a base with concentric sides extending upward, a cone resting above the base with a rectangular, cylindrical, oblong, etc. cross-section on which is mounted a cast iron support frame that supports a grating. Sometimes, a rectangular top slab may be positioned directly above the cone. The rectangular top slab is used to narrow the opening in the cone and supports either a rectangular or concentric cast iron support frame. The catch basin structure is also built up to an elevation such that the grating will be approximately at road level, with rectangular spacers being employed to ensure that the grating will be at grade level.

From time to time, roads are required to be resurfaced. When the road is resurfaced, a layer of paving material is deposited over the existing pavement. Consequently, the manhole cover and grating level will be below the top surface of the new pavement. At the time that the road is resurfaced, the manhole cover and grating must also be raised to the new level to avoid having a recess in the roadway. These recesses produce unwanted bumps and shock to vehicles passing over the depression and also create sites where water can collect. Freezing of such water can result in damage to the road resurfacing material.

Occasionally, the manhole and catch basin are constructed on a hillside. Usually, the bases are aligned vertically with the earth's gravitational line, not perpendicular to the surface or the hillside's vertical line. To avoid having a recess (pothole) in the roadway, the manhole cover and grating must be supported at an angle to the bases, equal to the angle between the gravitational line and the hillside vertical line. Thus, a need exists to efficiently change the angle of the manhole cover and grating to be flush with the resurfaced roadway.

The prior art has recognized a need to efficiently raise the level of the manhole flush with the resurfaced roadway. To meet this need, a variety of adapter rings and adjustment rings have been introduced, such as that described in U.S. Pat. No. 5,205,668. Each ring is arranged to rest on the upper rim of the cast iron support frame. Further, these adapter or adjustment rings include an annular lip on which the manhole cover can rest, raising the level of the manhole. These rings can be stacked or adjusted to provide varying heights. A disadvantage to these rings is that severe loadings tend to move them and cause the cover to become unstable and rock. Bolting the cover, adapter ring and the support frame together will prevent the cover from rocking, but the bolts, over time, become rusted and difficult to remove, requiring the entire unit to be replaced when a second resurfacing operation takes place.

Even with adapter rings available, U.S. Pat. No. 5,205,668 and U.S. Pat. No. 4,188,151 recognize that, rather than using adapter rings, it is still a common practice to remove the existing pavement around the manhole and increase the height of the manhole cover by placing support materials, such as bricks, on the cone top surface and then placing the support frame on top of the bricks. The disadvantage of this continued procedure is that laying mortar and brick is expensive and time-consuming. Thus, a need exists for a relatively inexpensive, rigid, lightweight spacer to be placed between the support frame and the cone top surface to raise the level of either the manhole cover or catch basin grating.

The present invention overcomes these disadvantages by providing a relatively inexpensive, sturdy, lightweight plastic spacer that is aligned between the cone top surface and the support frame. The plastic spacer member may also be aligned between the top slab and the support frame. One or more of such plastic spacers, having a high compressive strength, are quickly and easily stacked atop the cone top surface with the uppermost plastic spacer forming the surface on which the cast iron support frame rests. An adaptable wedge is provided that allows the manhole cover or grating to be supported at an angle relative to the top slab or cone. This change in angle allows the cover or grating to remain flush with a resurfaced roadway located on a hillside.

OBJECTS OF THE INVENTION

It is accordingly a principal object of the present invention to provide inexpensive manhole and catch basin adjustment spacer members to elevate a cover or grating to the desired level of the roadway in both new constructions or during resurfacing.

Another object of the invention is to provide lightweight manhole and catch basin adjustment spacers that can be positioned quickly and easily.

Another object of the invention is to provide interlocking manhole or catch basin adjustment spacers that interlock with the top slab or cone.

Still another object of the present invention is to provide either a continuous or segmented manhole and catch basin adjustment spacer having a life-expectancy far exceeding those made of concrete or ferrous metals.

A further object of the present invention is to provide manhole and catch basin adjustment spacers of high compressive strength.

Yet another object of the present invention is to provide easily sealable manhole and catch basin adjustment spacers that prevent water seepage into the system.

Another object of the present invention is to provide manhole and catch basin adjustment spacers made from post-consumer (recycled) plastics that are durable, and better capable of withstanding relatively high impacts, inclement climates, and exposure to road salt and other chemicals as compared to concrete.

Another object of the present invention is to provide a means to change the angle of the manhole cover or grating relative to the top slab or cone.

SUMMARY OF THE INVENTION

In accordance with the present invention, the foregoing objects and advantages are achieved by providing a molded relatively hard, plastic, member of predetermined geometric shape, preferably molded in one piece from a mix of recycled plastics. The molded plastic member has an inner and outer side wall, a web defining a pocket and interconnecting the two side walls, a planar support surface and an upper and lower shoulder extending from a center portion of the inner wall. The plastic member is designed to be aligned between the cone top surface of a manhole or catch basin and the support frame.

The plastic member, to be positioned between the cone top surface and the support frame, is shaped to conform to the opening of the cone or a top slab opening and the support frame. Hence, the plastic member may have one of the following shapes: an annular member, a rectangle, a square or any other geometric shape corresponding to the shape of the cone top surface or top slab opening and the support frame. However, an annular member is preferred for the manhole, and a rectangular ring is preferred for the catch basin. The general features of the inner and outer side walls, the upper and lower shoulders, the planar support surface, and the webs remain the same within any conforming shape of the plastic member.

The annular plastic member has inner and outer concentric, spaced-apart, walls. The radius of the outer wall is greater than the radius of the inner annular wall. The inner and outer annular walls are connected to one another by radially extending webs that define a plurality of pockets. The pockets reduce the total weight of the annular member, allowing ease in handling the plastic member during installation. These pockets may each have a relatively planar support surface, flange or lip extending perpendicularly from the top of either the inner or outer wall. The planar support surface, flange or lip provides rigidity and support to the plastic member. Further, this platform defines a surface on which the support frame footing or webs of another plastic member may rest. A "fifty-year caulk" may be applied to the planar support surface, thereby creating a water tight seal between the uppermost annular plastic member and the support frame.

The inner vertical annular wall has an upper and lower section that is radially offset relative to a center section, thereby defining an upper and lower annular shoulder. The lower annular shoulder is designed to interlock with the upper annular shoulder of other annular member, when it is necessary to stack annular members to provide the desired elevation to the cast iron support frame. A caulking may be applied between the two annular shoulders creating a water-tight seal. The lower annular shoulder of the bottommost annular member also interlocks with fictile concrete poured on the cone top surface. The bottom of the outer vertical wall has a plurality of gaps extending through the wall into the pocket. These gaps allow any condensation or moisture to drain to the outside of the manhole structure rather than into it.

When used, the plastic annular member is positioned on the top surface of the cone with the lower annular shoulder projecting downward into the central cone opening. The lower annular shoulder interlocks with the cone preventing excessive lateral movement of the annular member. The user continues to align and stack annular members until the desired height for the top surface has been reached. A caulk may be applied between each of the engaged surfaces forming a water tight seal between any interlocked annular members, the support frame, and the cone.

The present invention may be used in newly constructed roads or in resurfacing existing roadways. In surfacing or resurfacing roads, the desired number of interlocking annular members multiplied by the thickness of each annular member is made to equal the height needed to make the cover or grating flush with the roadway. When the desired number of annular members has been determined and put in place, the support frame may be aligned and engaged on top of the uppermost annular member. The manhole cover or grating is then positioned on the support frame. The road may then be surfaced or resurfaced with the manhole cover and grating's level being the same as the surfaced or resurfaced road level.

When constructing or resurfacing a roadway on a hillside, at least one wedge may be positioned between the top surface of the cone and the plastic member. The angle of the cover or grating is changed relative to the cone, causing the manhole cover and grating to be flush with the resurfaced roadway.

The foregoing features and advantages of the present invention will be readily apparent to those skilled in the art from a review of the following detailed descriptions of the preferred embodiment in conjunction with the accompanying drawings and claims.

DESCRIPTION OF THE DRAWINGS

FIG. 3-A is a cross-sectional view taken along line A—A of FIG. 3.

FIG. 10-A is a cross-sectional view taken along line A—A of FIG. 10.

FIG. 10-B is a cross-sectional view taken along line B—B of FIG. 10.

FIG. 10-C is a cross-sectional view taken along line C—C of FIG. 10.

DETAILED DESCRIPTION OF THE PREFERRED EMBODIMENT

Figure 1:
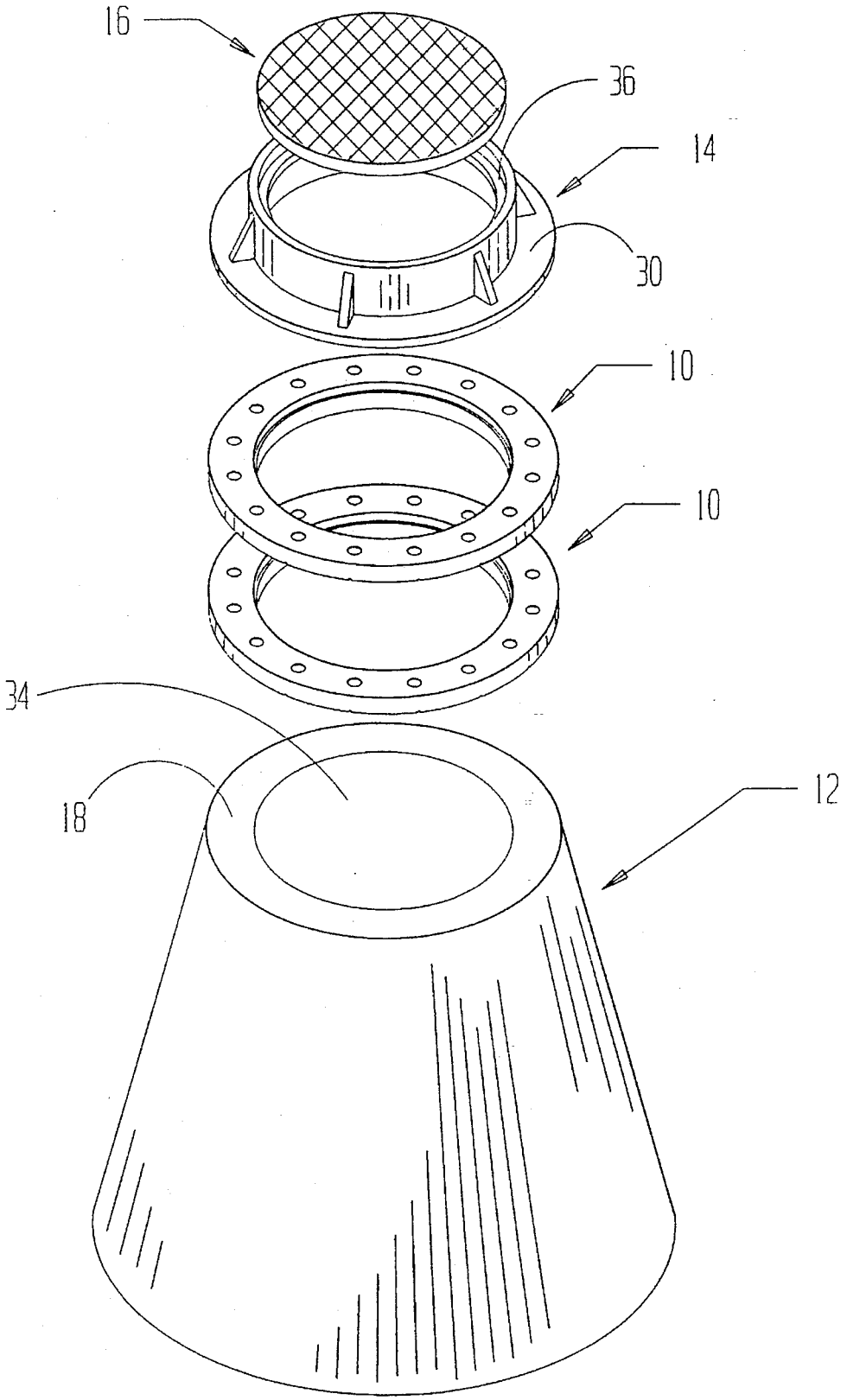
FIG. 1 is an exploded perspective view of a manhole cone, a plurality of molded plastic annular spacer members, a manhole cover support frame and a manhole cover.
Figure 9:
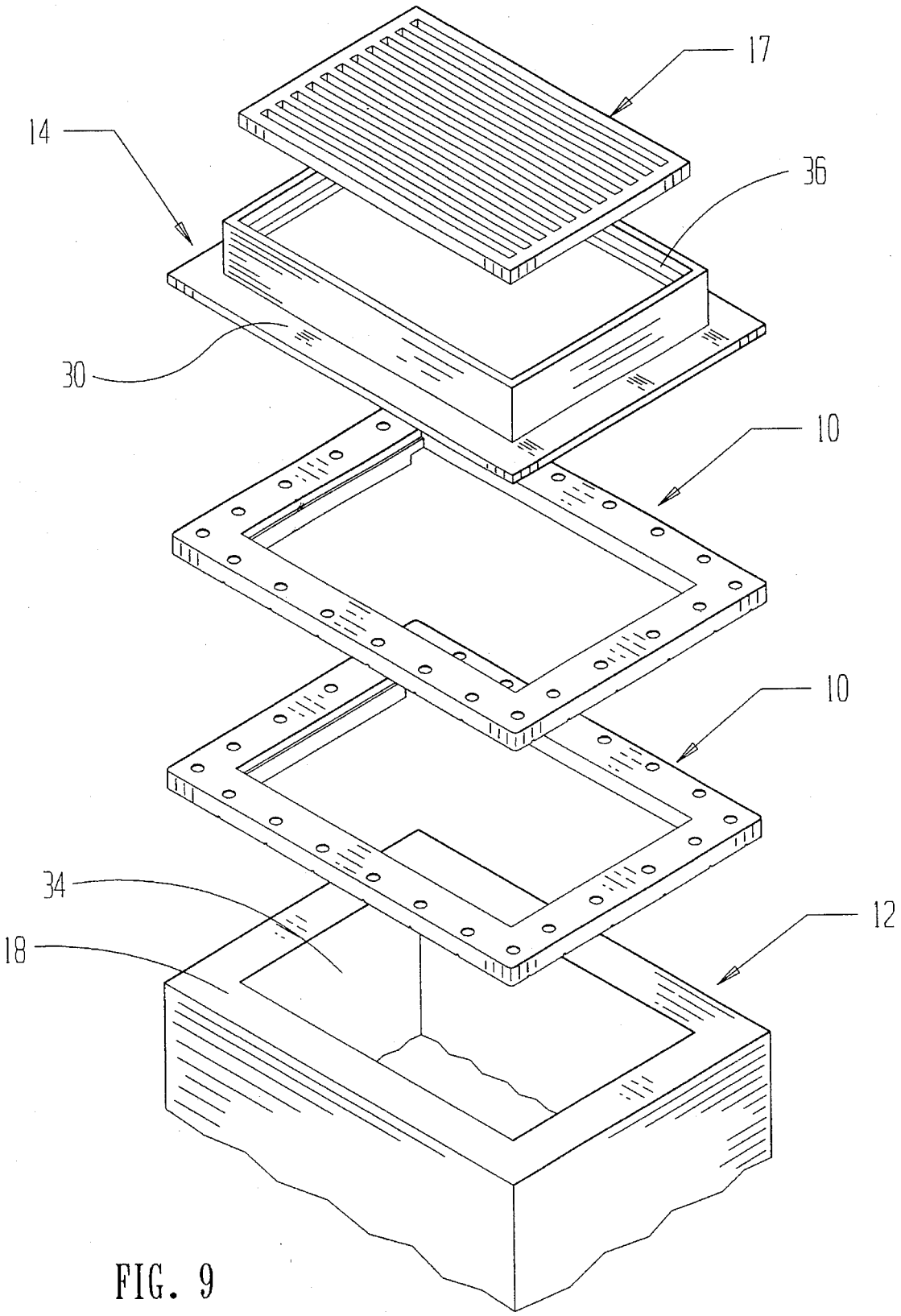
FIG. 9 is an exploded perspective view of a catch basin cone, molded plastic rectangular members, a grating support frame, and a grating.

Referring first to FIG. 1, there is indicated generally a brick or concrete cone 12, first and second molded plastic annular members 10, a support frame 14, and a cover 16. Typically, the cone 12 is frusto-conically shaped with a concentric open end 34. In the alternate preferred embodiment, the plastic members 10 of the present invention can have different shapes to conform to the shape of the cone 12 and support frame 14 (see FIG. 9). Without limitation, the outside diameter at the top of the conically shaped cone 12 may be approximately 36 inches.

Figure 2:
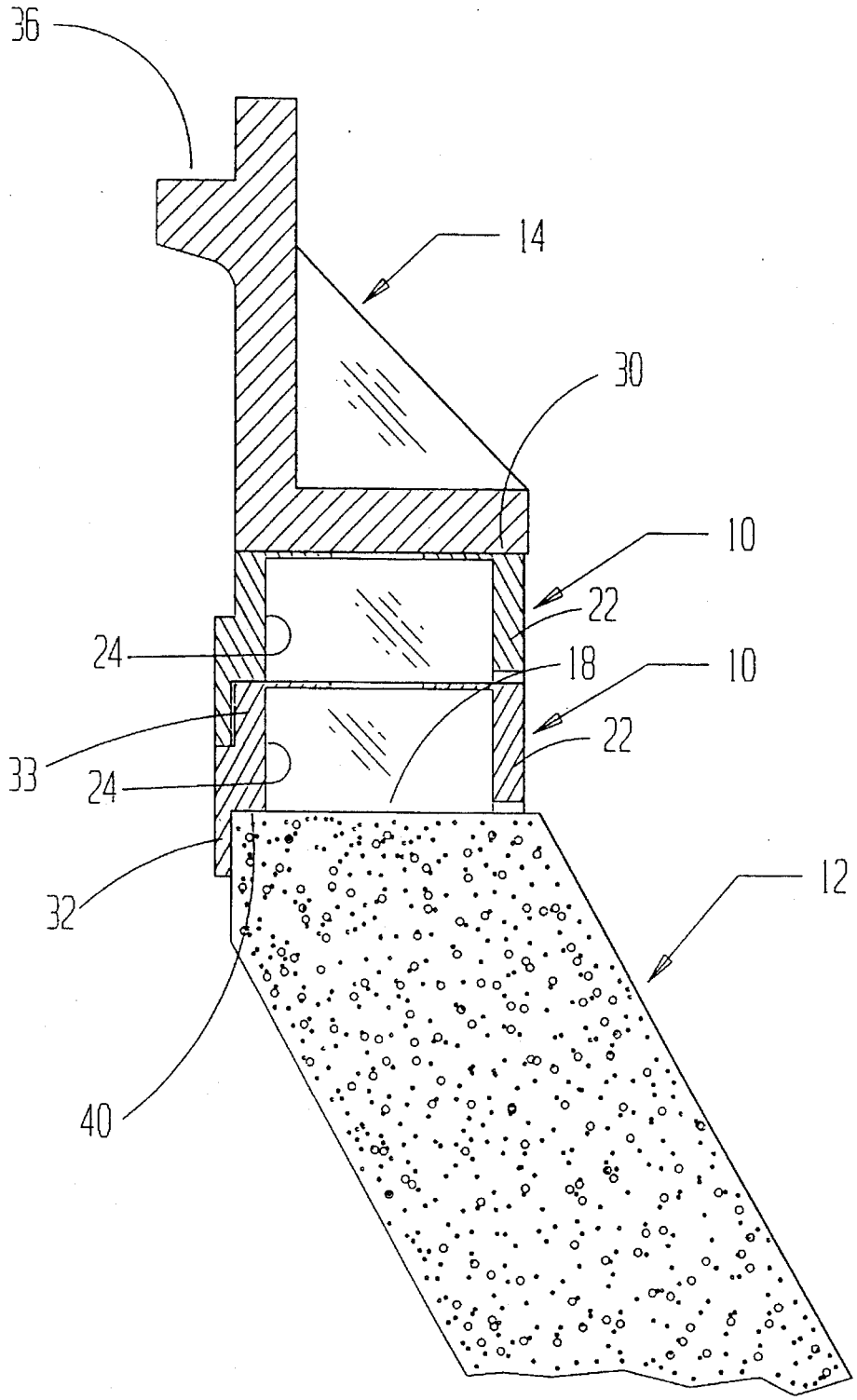
FIG. 2 is a partial sectional view of a manhole cone, a pair of molded plastic annular members and a manhole cover support frame all aligned and engaged.

The top support surface 18 of the cone 12 is relatively flat and is positioned parallel to the horizon. The molded plastic annular members 10 rest directly on the top support surface 18 of the cone 12 (see FIG. 2). As earlier stated, the cone is generally constructed out of concrete. However, other suitable materials, such as brick and mortar or some other industrial material commonly used in underground sanitary and storm sewers, or utility conduits, of course, can be used without deviating from the invention.

To help reduce the demand for new plastics, the molded plastic annular member 10 is preferably constructed from recycled plastic with melting points greater than about 400° F. and having a relatively high compression rate. Plastic members molded from recycled plastic having the above listed qualities have the ability to withstand a crushing load of 65,000 psi or more. Of course, other suitable materials may be used without deviating from the present invention.

Figure 3:
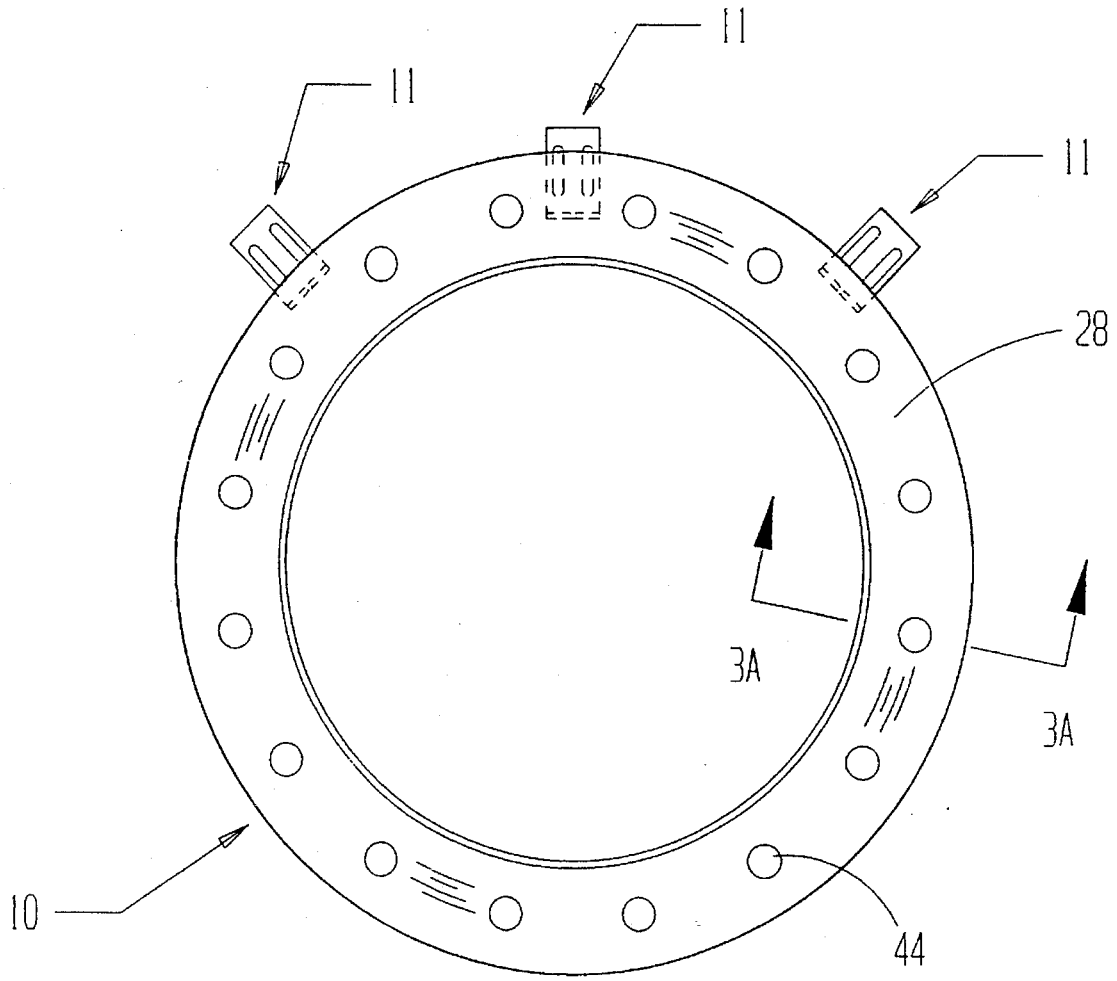
FIG. 3 is a plan view of the molded plastic annular member in accordance with one embodiment of the invention with wedges aligned and engaged.
Figure 3A:
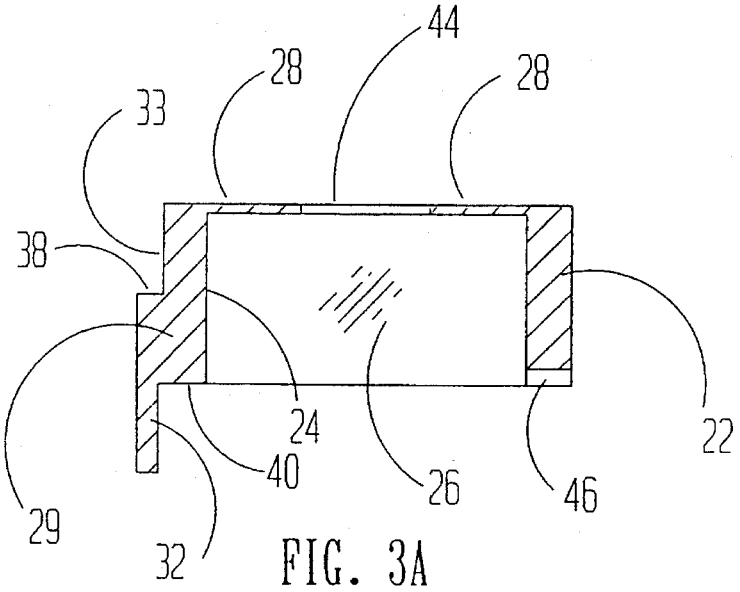

The molded plastic member 10, best shown in FIGS. 3, 3-A, and 4, has a first (outer) annular side wall 22 and a second concentric, spaced-apart (inner) annular side wall 24. The two are connected to one another by a plurality of radially extending webs 20. These webs 20 define a corresponding plurality of pockets 26. The pockets 26 reduce weight and economize on materials.

Figure 12:
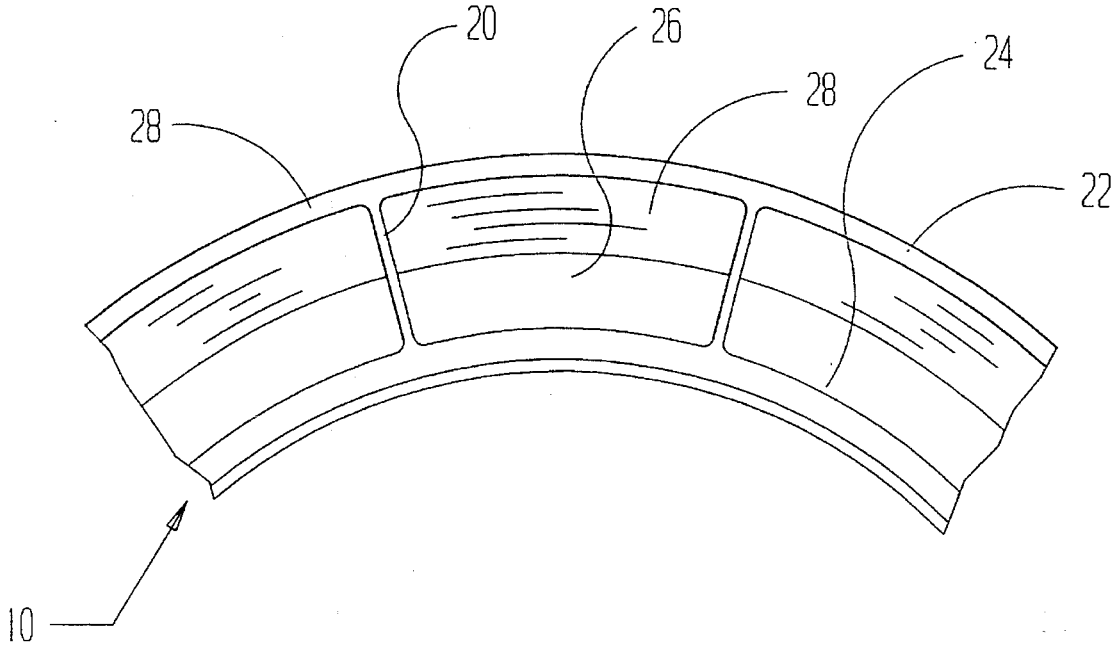
FIG. 12 is a partial bottom view of an alternate preferred embodiment of the webs, and pockets of the annular member of the type shown in FIG. 3.
Figure 13:
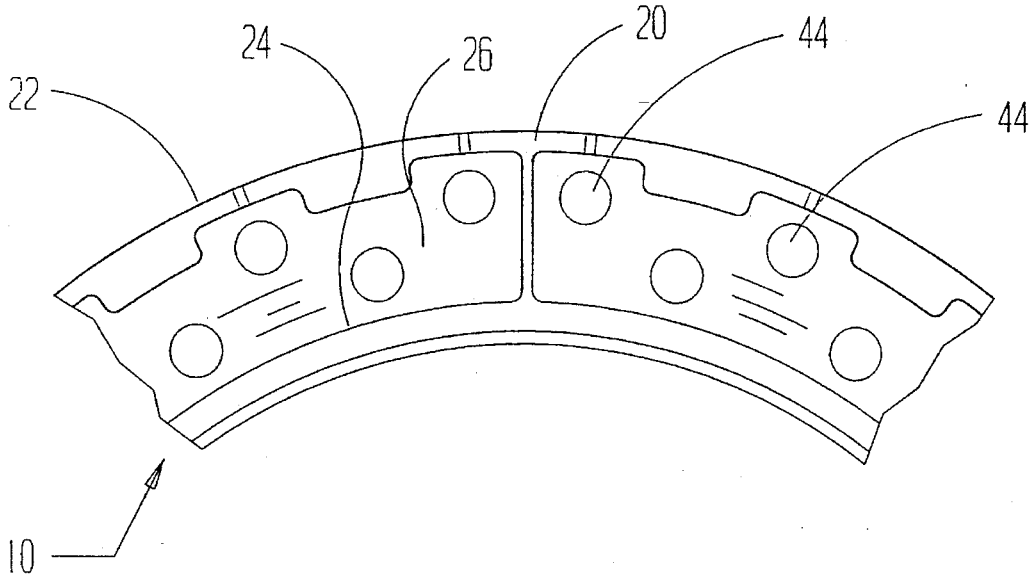
FIG. 13 is a partial bottom view of an alternate preferred embodiment of the webs, and pockets of the annular member of the type shown in FIG. 3.
Figure 14:
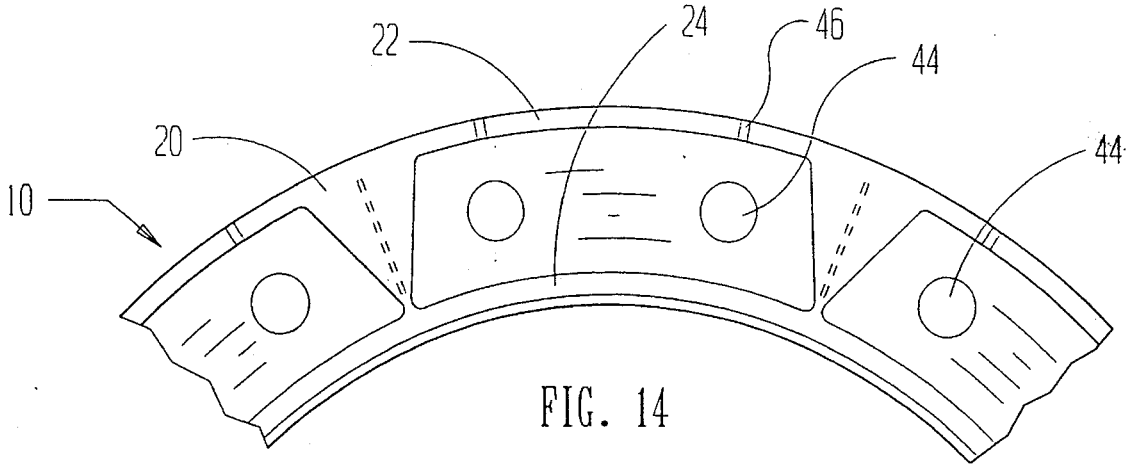
FIG. 14 is a partial bottom view of another alternate preferred embodiment of the webs, and pockets of the annular member of the type shown in FIG. 3.
Figure 15:
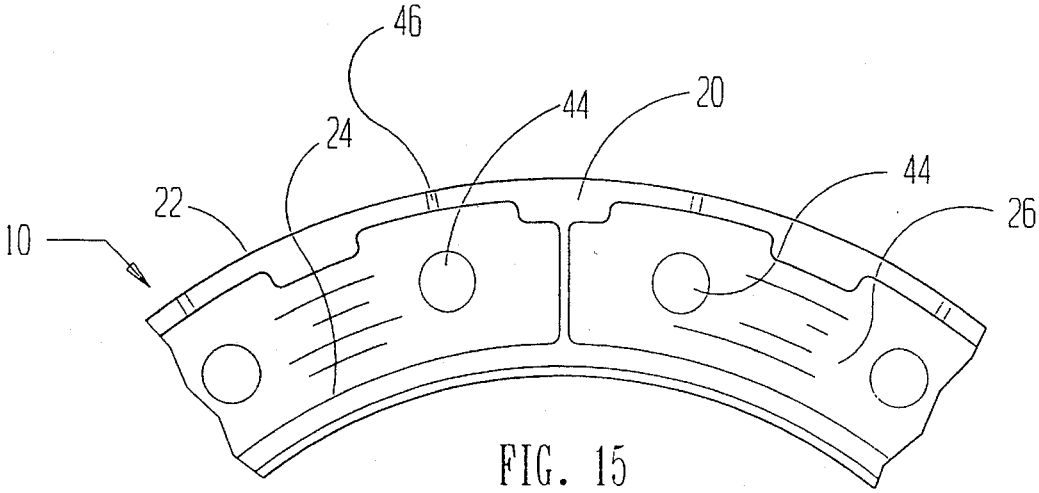
FIG. 15 is a partial bottom view of still another alternate preferred embodiment of the webs, and pockets of the annular member of the type shown in FIG. 3.
Figure 16:
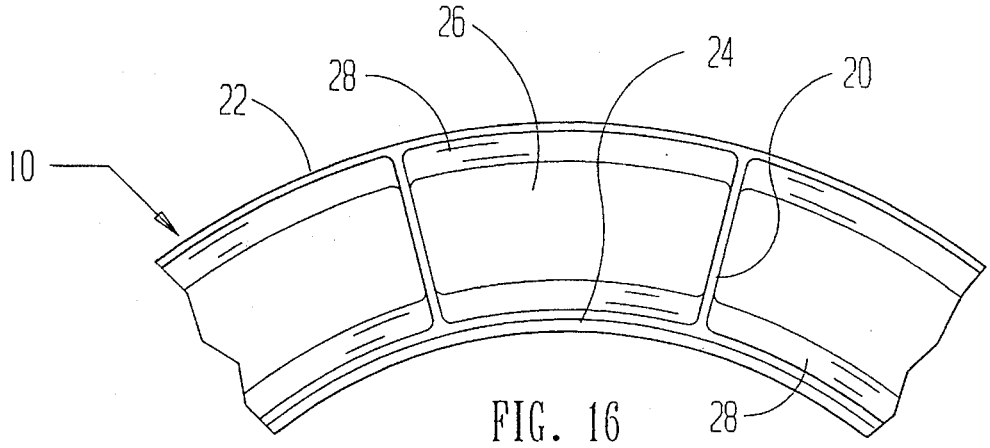
FIG. 16 is a partial bottom view of an alternate preferred embodiment of the webs, and pockets of the annular member of the type shown in FIG. 3.
Figure 17:
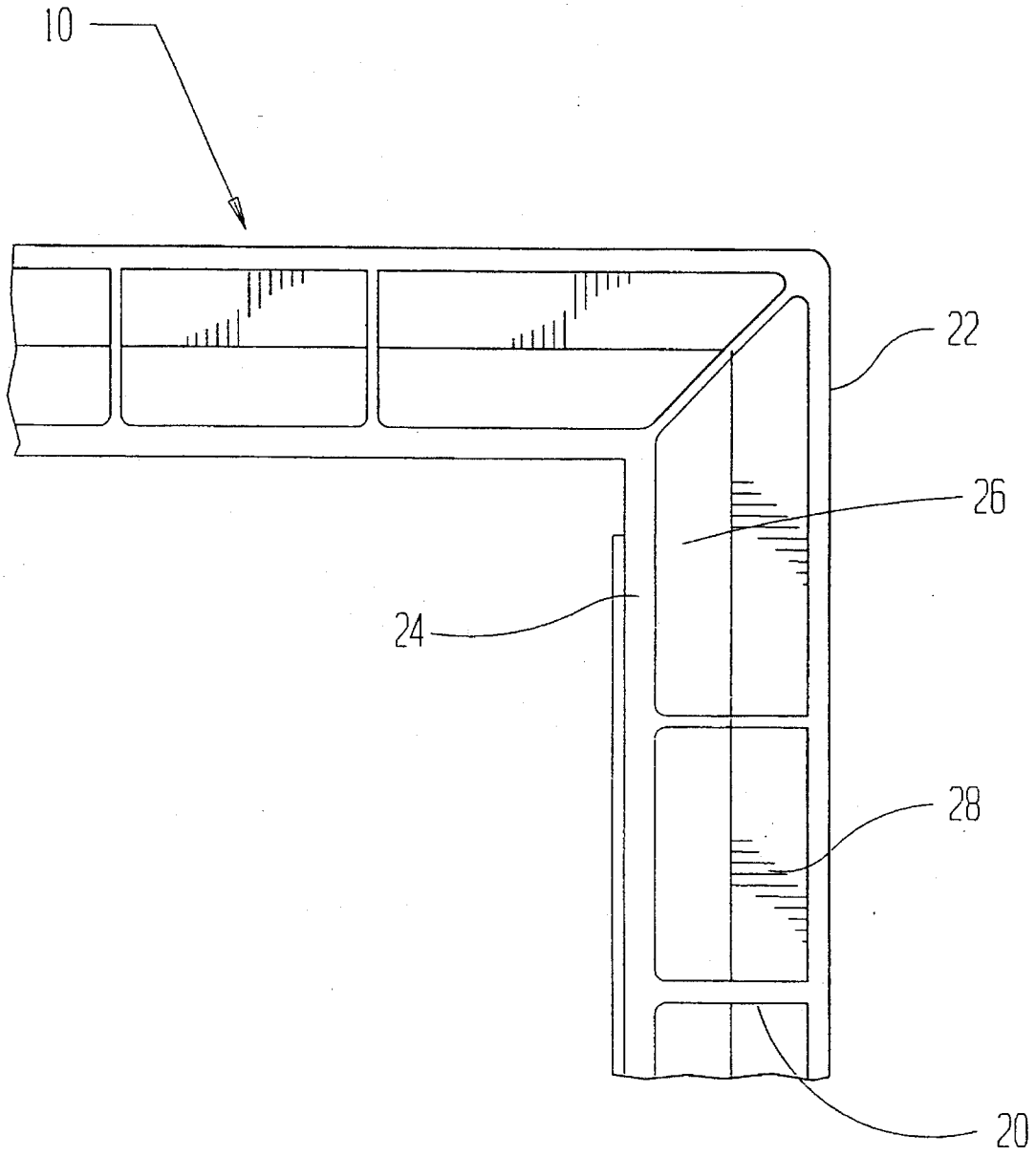
FIG. 17 is a partial bottom view of an alternate preferred embodiment of the webs and pockets of the c-shaped spacer member of the type shown in FIG. 10.
Figure 18:
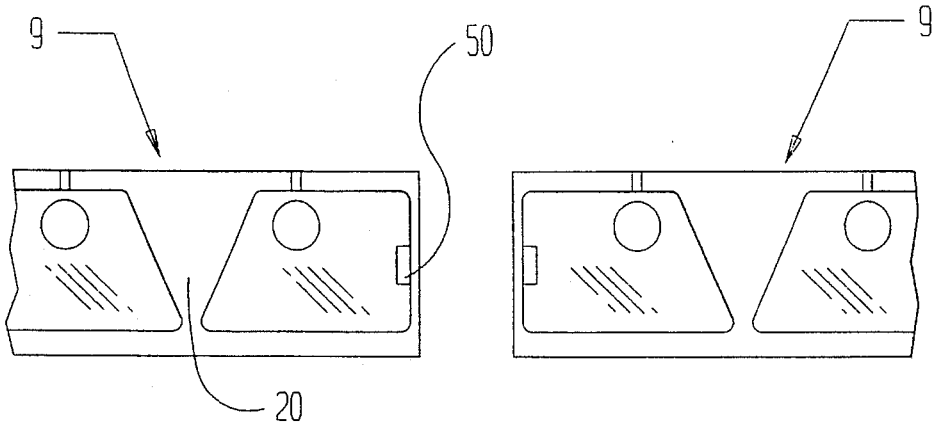
FIG. 18 is a partial bottom view of an alternate preferred embodiment of the webs, pockets, and interlocking means of the rectangular spacer member of the type shown in FIG. 10.
Figure 19:
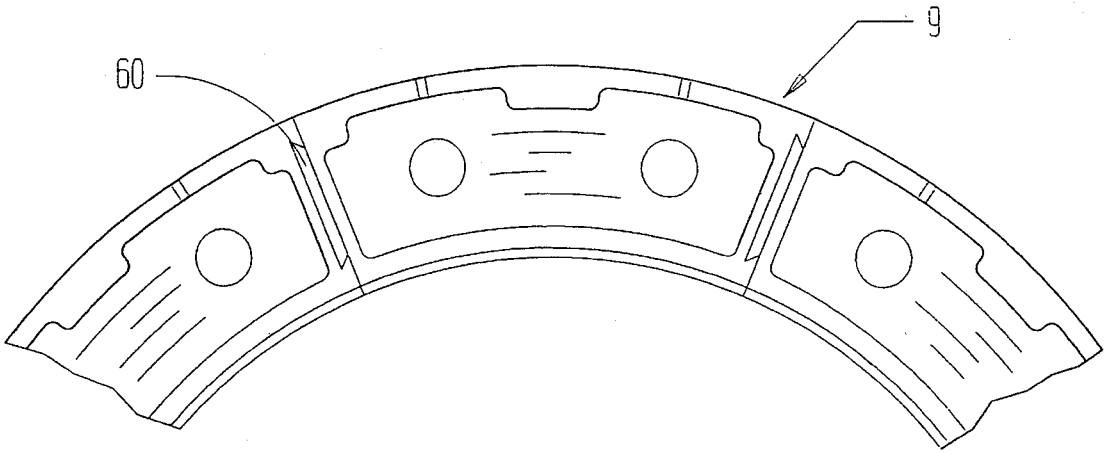
FIG. 19 is a partial bottom view of an alternate preferred embodiment of the webs and pockets of a segmented interlocking molded plastic annular member of the type shown in FIG. 3.
Figure 20:
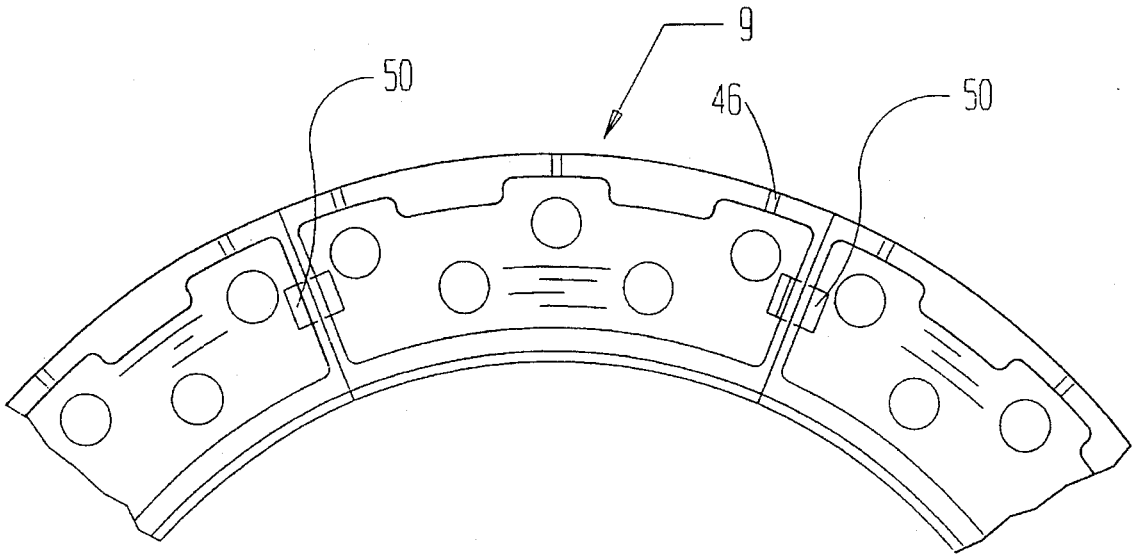
FIG. 20 is a partial bottom view of an alternate preferred embodiment of the webs and pockets of a segmented interlocking molded plastic annular member of the type shown in FIG. 3.

A planar support surface, flange, or lip 28 may extend perpendicularly from either the outer annular side wall 22 or the inner annular side wall 24 upper edge (see FIGS. 12, 16 and 17). The planar support surface, flange, or lip 28 may extend completely from the outer side wall 22 to the inner side wall 24, thereby enclosing the top end of the pocket 26 (see FIGS. 3 and 3-A). The planar support surface, flange, or lip 28 provides greater rigidity to the annular member 10 and also provides a support surface for the support frame 14 or another annular member 10. To further reduce weight and economize on material, without compromising the effectiveness of the support surface 28, a plurality of apertures 44 may extend through the support surface, flange, or lip 28 (see FIGS. 3, 3-A, and 4). The apertures 44 may be positioned in a variety of symmetric locations (see FIGS. 13–15).

Figure 4:
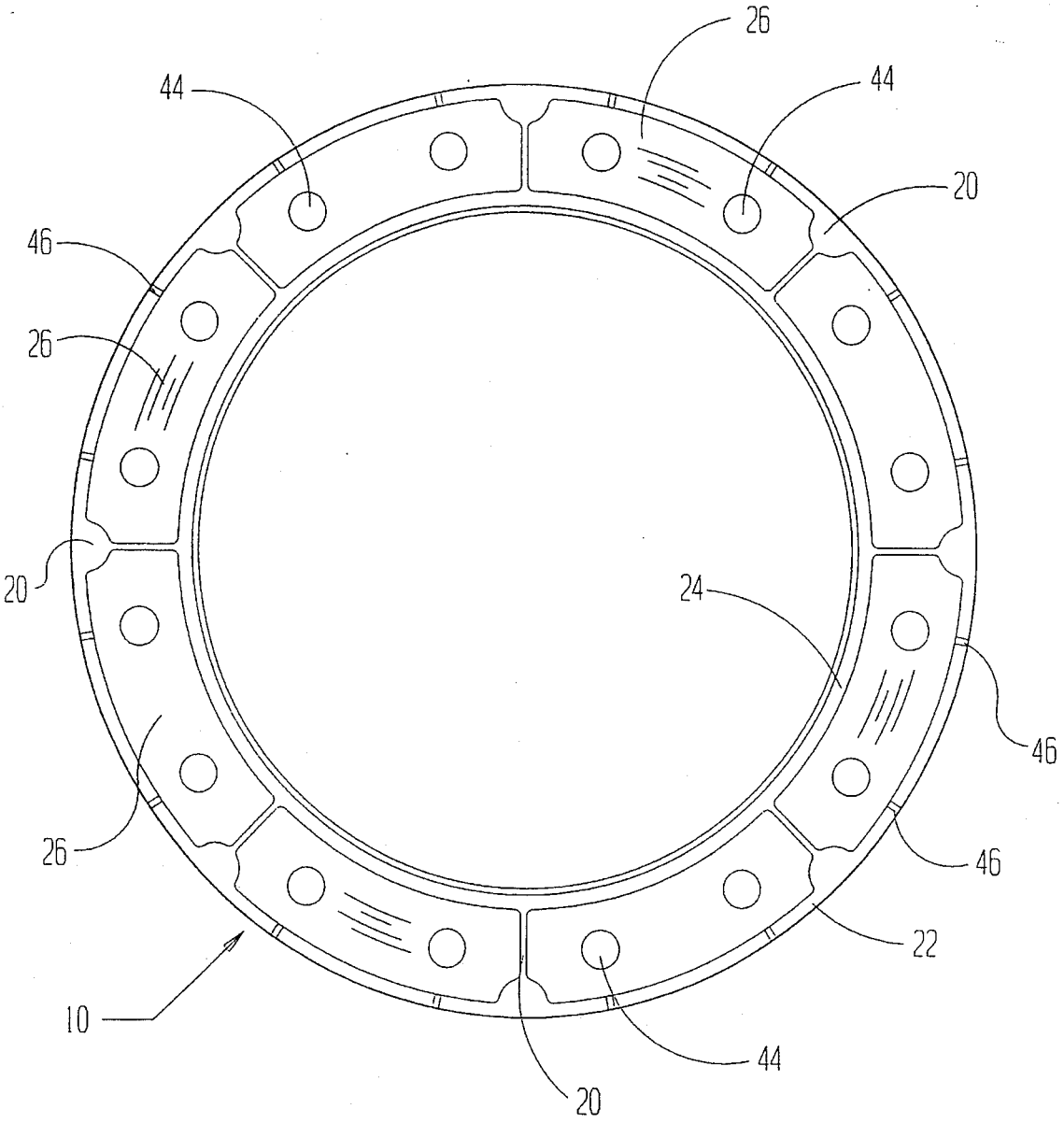
FIG. 4 is a bottom view of the molded plastic annular member of the type shown in FIG. 3.

The radially extending webs 20 that define the pockets 26 provide support between the manhole cone 12 top surface 18 and the support frame 14. The webs 20 may be formed in various geometric shapes including, but not limited to: a square, a triangle, an ellipse, a rectangle, a semi circle, an oval, a cylinder, a sphere, and any combination of the above, to define the pocket (see FIGS. 4, 10, and 12–16). However, a combination of a semi-circle with an extended rectangle is preferred (see FIG. 4). This combination provides an increased bearing surface, without unnecessarily increasing the total area of the plastic member 10.

Figure 6:
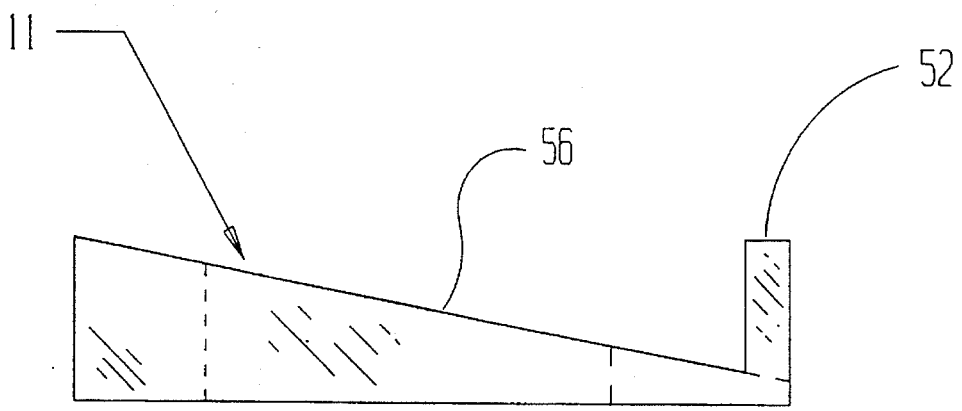
FIG. 6 is a side view of the molded plastic wedge of the type shown in FIG. 5.
Figure 5:
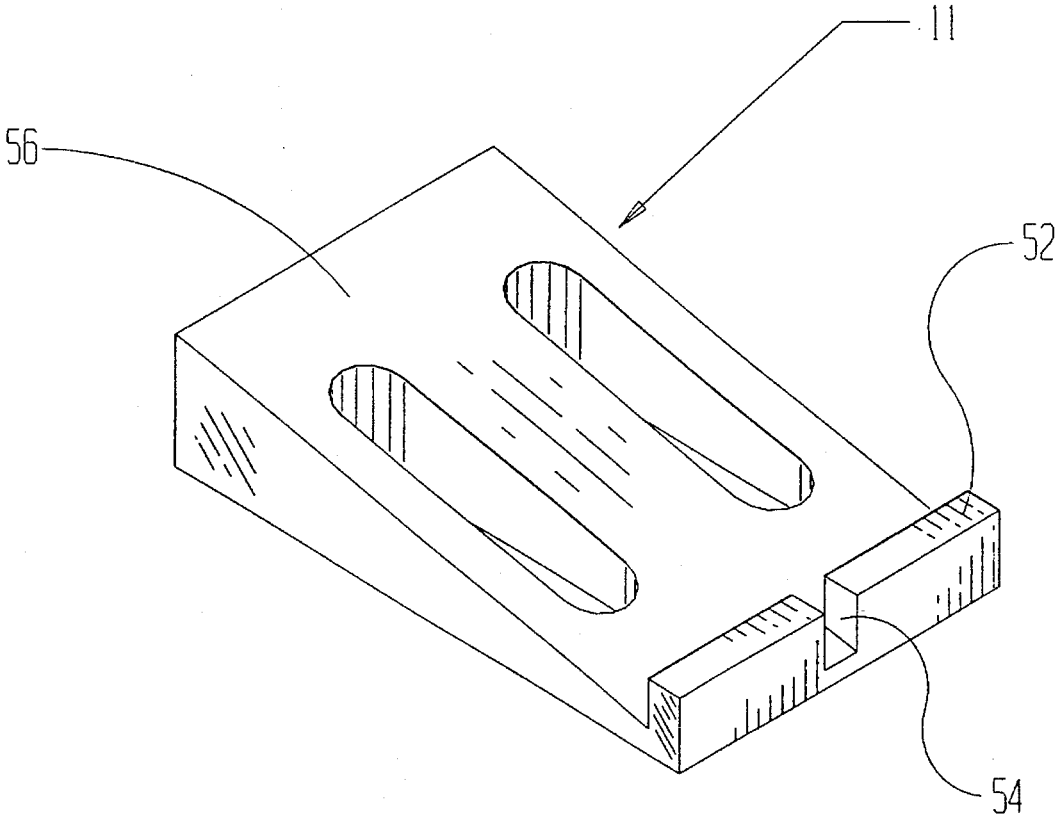
FIG. 5 is a perspective view of a molded plastic wedge sometimes used with the annular members of the type shown in FIG. 3.
Figure 8:
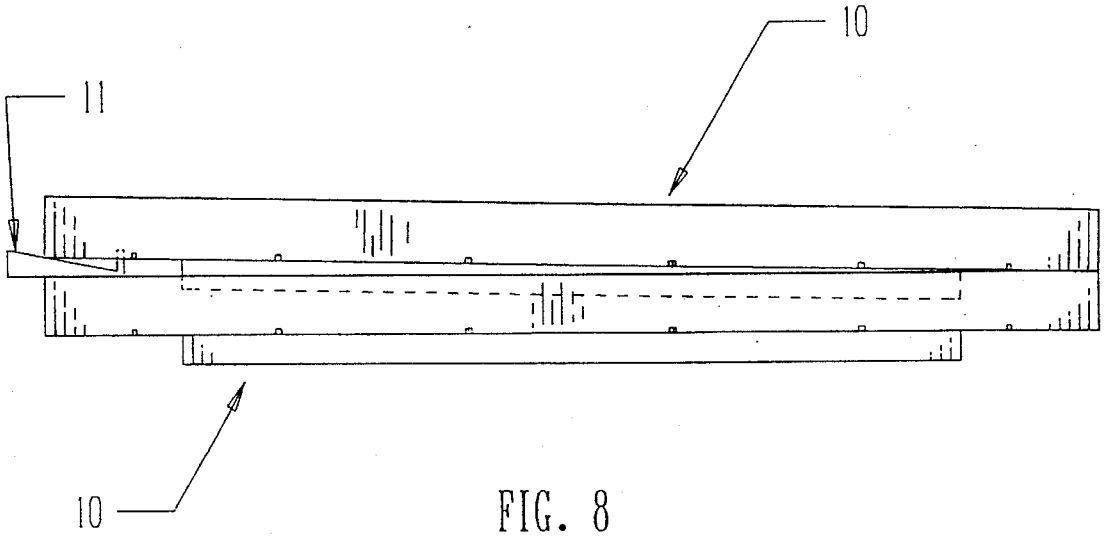
FIG. 8 is a side elevational view of two molded plastic annular members, of the type shown is FIG. 3, aligned and engaged with a wedge of the type shown in FIG. 5, aligned and engaged.

Referring to FIGS. 5 and 6, a wedge 11 having a predetermined inclined surface 56, is designed to engage with the webs 20 changing the slope of the planar support surface 28 (see FIG. 8). The wedge has a thickness dimension defining the inclined surface 56. The inclined surface 56 slopes uniformly across the length dimension, having a first and second height dimensions. The slope allows the support frame 14 to be positioned at an angle relative to the horizontal top support surface 18 of the cone 12. Extending from the inclined surface 56 is a rail 52. The rail 52 has a slot 54 that aligns and engages with the web 20 of the annular members 10. In the alternative, the planar support surface 28 may extend from either the inner side wall 24 or the outer side wall 22 at a sloping angle, allowing the support frame 14 to be positioned at an angle relative to the top surface of the cone 12.

As shown in FIG. 3-A the inner annular wall 24 has a center portion 29 that is about twice as thick as the lower and upper shoulder portions 32 and 33, thereby defining annular ledges 38 and 40 that are vertically offset from each other and extend in opposite directions. The lower annular shoulder portion 32 extends downward from the thicker center portion 29, and perpendicular to annular ledge 40. The upper annular shoulder 33 extends upward from the center portion 29 perpendicular to annular ledge 38.

The lower annular shoulder 32 of the bottommost annular member interlocks with the cone 12 or top slab 18. The bottom of the outer vertical wall 22 has a plurality of gaps 46 extending through the outer wall 22 into the pocket 26 (see FIGS. 3-A, 4, 10, and 10-A). These gaps 46 allow any condensation or moisture to drain to the outside of the manhole structure. Drainage to the outside of the manhole structure is desired to prevent external liquids, including rain water, from entering into the sewage system, thereby, overloading the sewage treatment facility.

Figure 7:
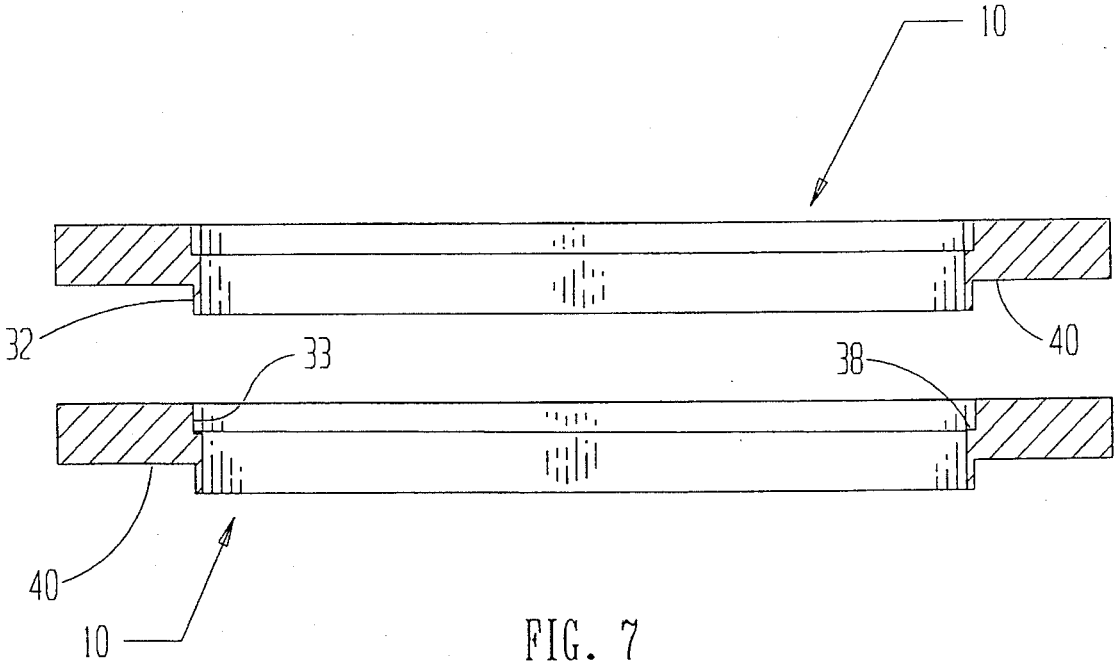
FIG. 7 is an exploded sectional view of two molded plastic annular members, of the type shown in FIG. 3, aligned and elevated one from the other.

A caulking material may be placed on the annular ledge 40, which rests on the top support surface 18 of the cone 12. A water tight seal is thus formed preventing external water from entering the cone. A caulking may also be applied to the annular ledge 38. When another annular member 10 is stacked, a water tight seal is formed between the lower spacer members annular ledge 38, and the upper spacer members annular ledge 40. FIG. 7 shows two annular members aligned and ready to be stacked.

In the preferred embodiment, the plastic member to be positioned between the cone 12 and the support frame 14 is shaped to conform to the open end 34 of the cone 12 and the support frame 14. Hence, the plastic member 10 may have one of the following shapes: a circular member, a rectangle, a square or any other geometric shape corresponding to the shape of the open end 34 of the cone 12 and the cover support frame 14. The general features of the inner side wall 24 and outer side wall 22, the upper shoulder 33 and the lower shoulder 32, the planar support surface 28, and the webs 20 remain the same within any conforming shape of the plastic member 10.

Figure 10:
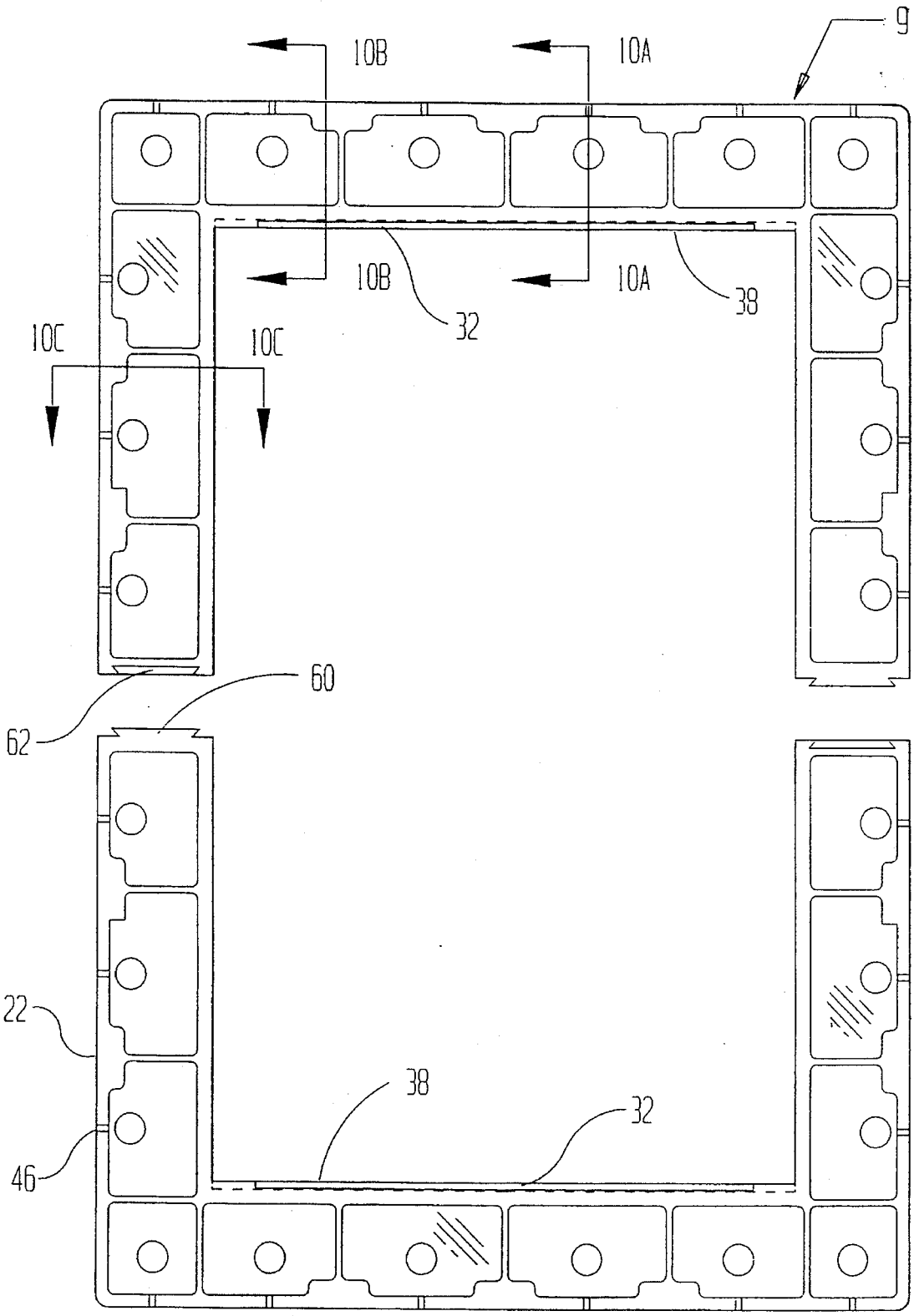
FIG. 10 is a bottom view of the molded plastic rectangular spacer member of the type shown in FIG. 9.
Figure 10A:
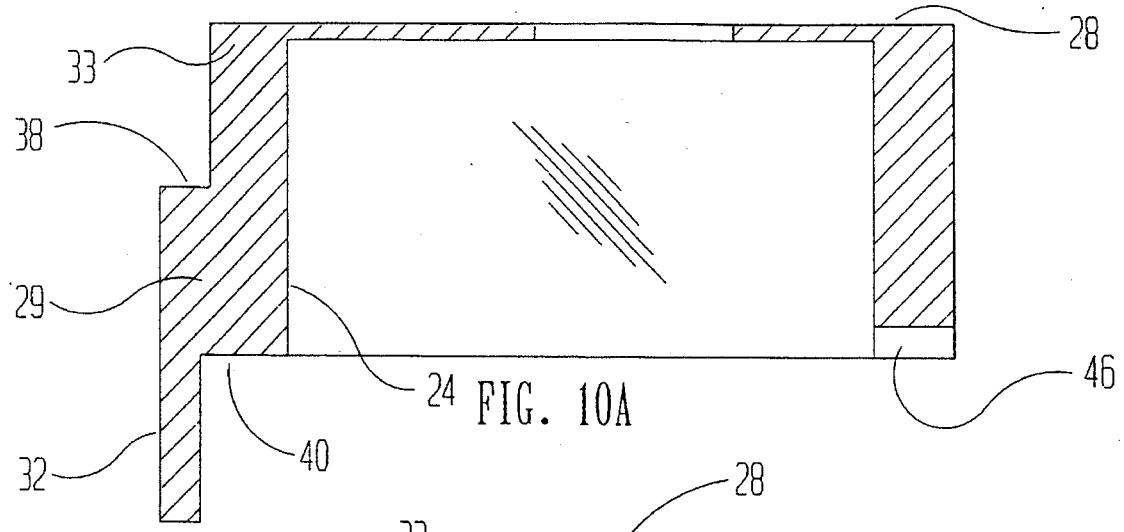
Figure 10B:
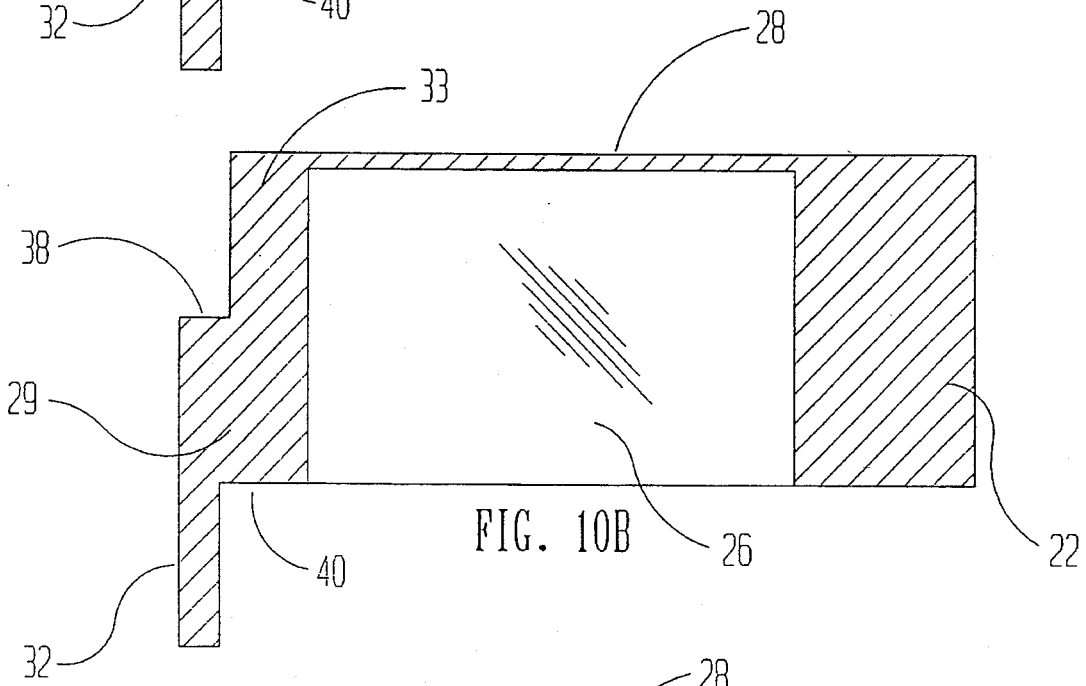
Figure 10C:
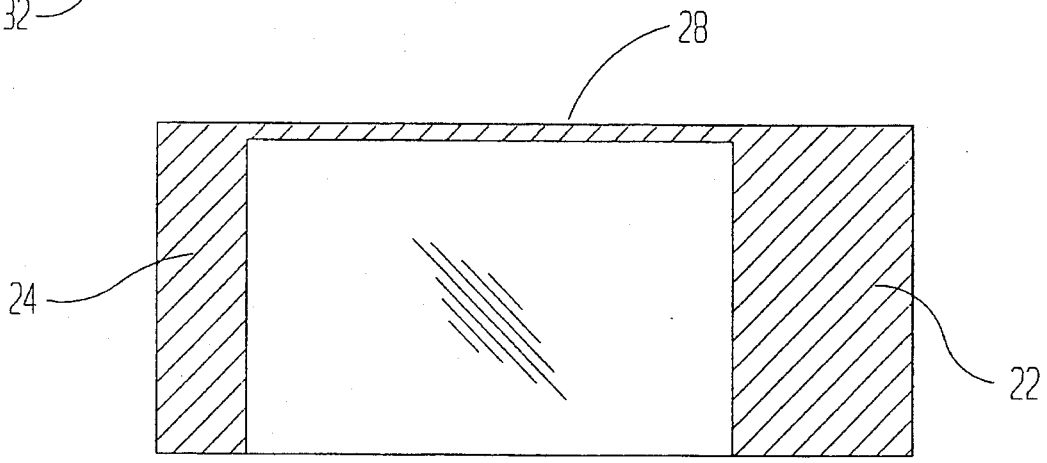
Figure 21:
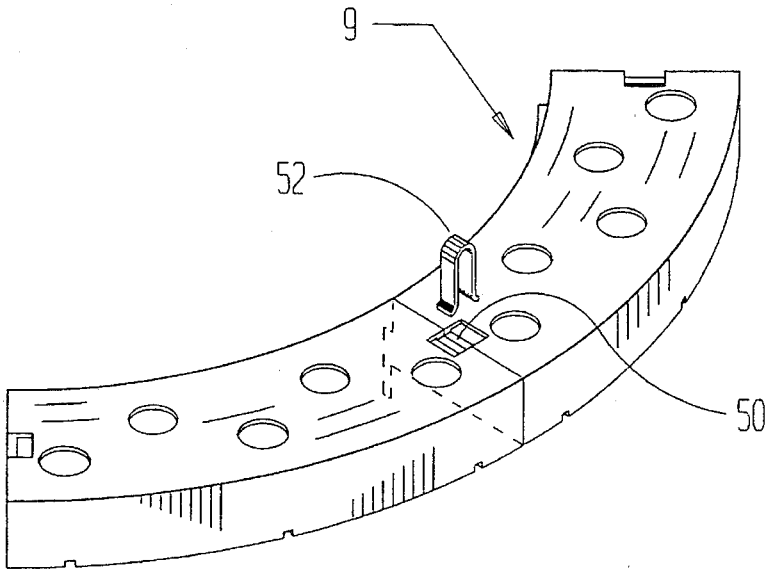
FIG. 21 is a partial perspective plan view of engaged segmented interlocking molded plastic annular members of the type shown in FIG. 20, with an interlocking clip aligned and elevated above the segmented annular members.

Without limitation, the plastic member 10 may be molded in a continuous shape or segmented to allow a plurality of aligned segmented members 9 to create the conforming shape. However, a continuous member is preferred. Referring to FIGS. 18–21, a segmented plastic member 9 may have an interlocking means. FIG. 10 shows a dovetail 60 and 62 interlocking means and FIG. 21 shows recesses 50 for receiving a clip 52 as the interlocking means associated with it. Further, the segmented plastic member 9 may be formed in an interlocking c-shape, so that when placing the open ends adjacent to each other a relatively rectangular member is formed (see FIG. 10). This c-shaped member may be positioned between a catch basin cone 12 and the catch basin support frame 14. Being rectangular, it can be made to conform to the curb line of the roadway.

Figure 11:
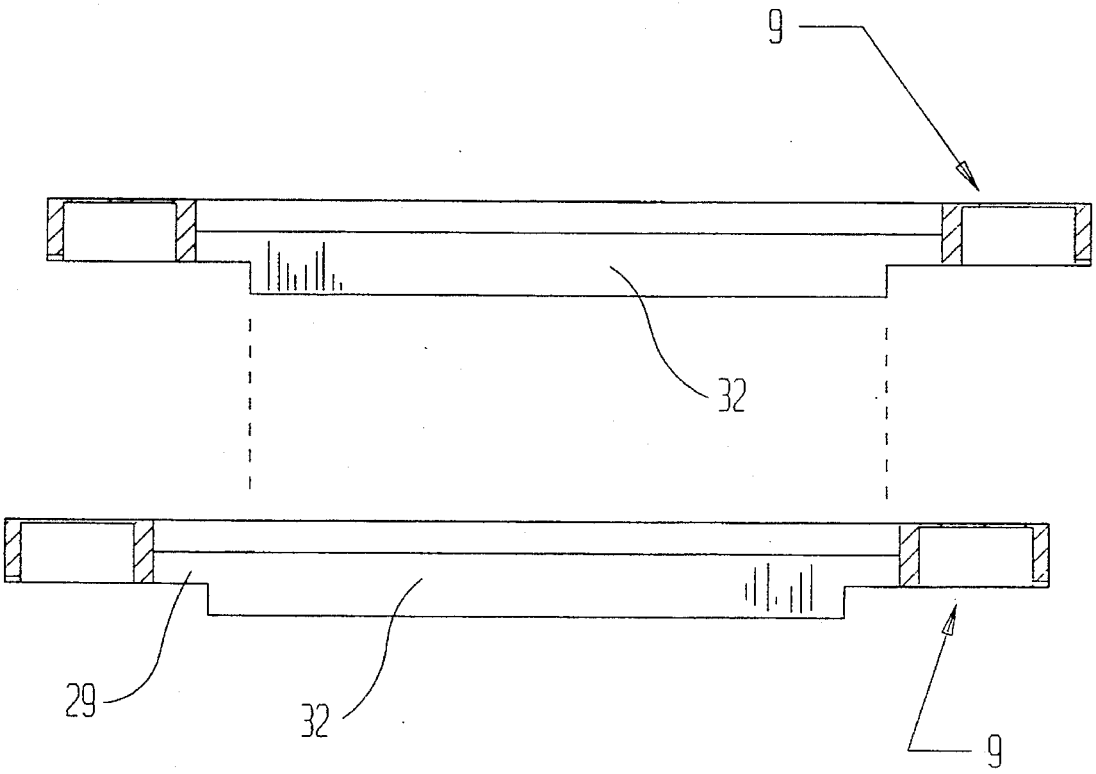
FIG. 11 is a side view of two molded plastic rectangular spacer members, of the types shown in FIG. 10, offset and aligned with respect to one another.

The c-shaped segments have a lower shoulder 32 extending from the center portion 29 of the inner vertical wall 24 along the sides (see FIG. 10-B). Further, the lower shoulder 32 does not extend downward along the entire center portion 29 of the inner vertical wall 24. Hence, two interlocked stacked c-shaped segments may be offset one from the other (see FIG. 11). When surfacing or resurfacing a roadway, the position of the curbline relative to the catch basin cone 12 is changed. This change in positioning of the curbline requires a shifting of the planar support surface relative to the catch basin cone 12. Two offset stacked rectangular plastic members 10 changes the position of the planar support surface 28 relative to the catch basin cone 12, thereby providing for the required shifting of the planar support surface.

With reference again to FIGS. 1 and 2, the support frame 14 has a support frame base or footing 30 which is adapted to be aligned and positioned on the planar support surface 28 of the uppermost molded plastic member 10. The support frame 14 has an annular lip 36 on which the manhole cover 16 or grating 17 can rest. The support frame 14, cover 16 and grating 17 are typically constructed of cast iron. In the preferred embodiment, the inside dimensions of the open end 34 of the cone 12, the plastic member 10, and the support frame base or footing 30 are all approximately equal. Likewise, the outside dimensions of the cone top surface 18, the plastic annular member 10, and the support frame footing 30 are all approximately equal.

Having described the constructional features of the molded plastic annular member 10, the mode of use will now be discussed. Prior to laying down the asphalt of the surfacing or resurfacing layer, the workers remove and set aside the existing cover support frame 14. They then align and position at least one plastic annular member 10 onto the cone's support surface 18. The lower annular shoulder 32 extends downward into the central opening 34 of the cone 12 with the ledge 40 engaging the cone support surface 18. A caulking may be applied to the support surface 18 to form a water tight seal.

The desired number of conforming plastic members 10 are stacked with the lower annular shoulder 32 engaging the upper annular shoulder 33 (see FIG. 7). Once the desired number of annular members 10 have been stacked to accommodate the thickness of the surfacing or resurfacing layer to be laid down, the support frame 14 is aligned in position with the support frame footing 30 resting on the planar support surface 28 of the uppermost annular member 10. The manhole cover 16 or grating 17 is then positioned on the support frame 14. The road is then surfaced or resurfaced with the level of the manhole cover or grating 17 being equal to the road level. The surfacing material precludes lateral shifting of the support frame and the annular members.

This invention has been described herein in considerable detail in order to comply with the Patent Statutes and to provide those skilled in the art with the information needed to apply the novel principles and to construct and use such specialized components as are required. However, it is to be understood that the invention can be carried out by specifically different equipment and devices, and that various modifications, both as to equipment details and the operating procedures, can be accomplished without departing from the scope of the invention itself.

What is claimed is:

1. An extension for use in manhole construction which comprises:

a molded plastic member having a shape conforming to the manhole construction, and further having a first (outer) and second (inner) concentric, spaced-apart, walls interconnected by a plurality of webs extending from said first and second walls to create a corresponding plurality of pocket spaces, said second wall having an upper and a lower section laterally offset in opposite directions relative to a center section to define an upper and a lower shoulder extending from said center section.

2. An extension as recited in claim 1 wherein at least one of said first and second concentric spaced-apart walls having a planar support surface extending perpendicularly from an upper edge thereof, to provide a surface of support.

3. An extension as recited in claim 1 wherein said webs are constructed in a geometric shape selected from the group consisting of: a square, a rectangle, an ellipse, a semi circle, an oval, a cylinder, a triangle, a sphere, and any combination of the above.

4. An extension as recited in claim 1 wherein said molded plastic member is a continuous concentric member conforming to the manhole construction.

5. An extension as recited in claim 1 wherein said molded plastic member is a segmented concentric member having interlocking means, such that an aligned and engaged plurality of said segmented concentric members conform to the manhole construction.

6. Apparatus for changing the spacing between a top surface surrounding an access opening of a cone of a manhole or catch basin having concentric inner and outer walls defining said top surface and a support frame designed to rest on said top surface prior to the surfacing or resurfacing of a street in which said manhole or catch basin is located, so that a cover or grating supported by said support frame will be flush with the level of the surfaced or resurfaced street, comprising:

a molded plastic member having concentrically disposed inner and outer wall members of a predetermined height dimension maintained in parallel spaced relation by a plurality of regularly spaced webs that link said inner and outer walls to define a plurality of pockets therebetween, at least one of said inner and outer walls of said molded plastic member including an offset segment for engaging one of said inner and outer walls of said cone, said webs being of a length to position the other of said first and second walls in approximate alignment with the other of said inner and outer walls of said cone; at least one of said inner and outer walls of said molded plastic member having a flange extending from an upper edge thereof, to provide a surface of support for the support frame.

7. The apparatus of claim 6 and further including a molded plastic wedge member having a thickness dimension that slopes uniformly across the length dimension thereof from a first height dimension to a second height dimension, said wedge member dimensioned to rest atop the top surface surrounding the access opening of the cone and directly beneath said web of said molded plastic member.

8. A device as recited in claim 6 wherein said inner and outer wall predetermined height dimension is in a range from 1½ inches to 3 inches.

9. A device as recited in claim 6 wherein said molded plastic member is comprised of recycled plastic.

10. A device as recited in claim 6 wherein said inner wall member includes an upper and a lower section radially offset relative to a center section to define an upper and a lower shoulder extending from said center section, wherein said lower shoulder is aligned and engaged with a portion of the top surface, and adjacent to the inner wall of said cone.

11. A device as recited in claim 6 wherein said inner wall member includes an upper and a lower section radially offset relative to a center section to define an upper and a lower shoulder extending from said center section, wherein said lower shoulder is aligned and engaged with an upper shoulder of a second molded plastic member when two such molded plastic members are stacked one atop the other.

12. A device as recited in claim 6 wherein said webs are constructed in a geometric shape selected from the group consisting of: a square, a rectangle, an ellipse, a semi circle, an oval, a cylinder, a triangle, a sphere, and any combination of the above.

13. A device as recited in claim 6 wherein said molded plastic member is a continuous concentric member conforming to the access opening of the cone.

14. A device as recited in claim 6 wherein said molded plastic member is a segmented concentric member having an interlocking means, such that an aligned and engaged plurality of said segmented concentric members conform to the access opening of the cone.

15. A spacer member adapted to be disposed between an access opening in a top surface of a manhole or catch basin cone and a support frame comprising:

a molded plastic member with inner and outer vertical walls extending between first and second major surfaces, said member having a plurality of spaced apertures extending perpendicular to said first and second major surfaces, said plastic member being aligned and engaged with the top surface of the cone; said second major surface supporting the support frame; said plastic member having a relatively equal height throughout.

16. A device as recited in claim 15 in which said plastic member is approximately two inches thick.

17. A device as recited in claim 15 in which said inner vertical wall further comprises an upper and lower section radially offset relative to a center section to define an upper and a lower shoulder thereon, wherein said lower shoulder being aligned and engaged with a portion of the top surface surrounding the access opening of the cone.

18. A device as recited in claim 15 in which said inner vertical wall further comprises an upper and lower section radially offset relative to a center section to define an upper and a lower shoulder thereon, wherein said lower shoulder being aligned and engaged with the upper shoulder of an additional plastic member when a pair of plastic members are stacked one atop the other.

19. A device as recited in claim 15 in which said spaced apertures are positioned symmetrically about said plastic annular member.

20. A device as recited in claim 15 in which said plastic annular member is comprised of recycled plastic.

21. A spacer member adapted to be disposed between an open top surface of a cone of a manhole or catch basin and a support frame comprising:

a molded plastic member having a first (outer) and second (inner) concentric, spaced-apart, vertical walls interconnected by a plurality of radially extending webs to create a corresponding plurality of pocket spaces, at least one of said first and second vertical walls having a lip extending perpendicularly from an upper edge thereof, to provide a support surface for the support frame, and said second vertical wall having an upper and lower section radially offset relative to a center section to define an upper and a lower shoulder thereon, wherein said lower shoulder is aligned and engaged with the inner edge of the open top surface.

22. A spacer member as recited in claim 21 in which said plastic member has a thickness in the range from 1½ to 3 inches.

23. A spacer member as recited in claim 21 in which said plastic member is comprised of recycled plastic.

24. A spacer member as recited in claim 21 and further including a molded plastic wedge member having a thickness dimension that slopes uniformly across the length dimension thereof from a first height dimension to a second height dimension, said wedge member dimensioned to rest atop the open top surface of the cone and directly beneath said web of said plastic member.

25. A spacer member as recited in claim 21 wherein said webs are constructed in a geometric shape selected from the group consisting of: a square, a rectangle, an ellipse, a semi circle, an oval, a cylinder, a triangle, a sphere, and any combination of the above.

26. A spacer member as recited in claim 21 wherein said plastic member is a continuous concentric member conforming to the open top surface of the cone.

27. A spacer member as recited in claim 21 wherein said plastic member is a segmented concentric member having an interlocking means, such that an aligned and engaged plurality of said segmented concentric members conforms to the open top surface of the cone.

28. A spacer member as recited in claim 21 in which said plastic member is further molded in a rectangular plastic member.

29. A spacer member adapted to be disposed between an open top surface of a cone of a manhole or catch basin and a support frame comprising:

a molded plastic member having a first (outer) and second (inner) concentric, spaced-apart, vertical walls interconnected by a plurality of radially extending webs to create a corresponding plurality of pocket spaces, at least one of said first and second vertical walls having a lip extending perpendicularly from an upper edge thereof, to provide a planar support surface for said support frame; said second vertical wall having an upper and lower section radially offset relative to a center section to define an upper and a lower shoulder thereon, wherein said lower shoulder may be aligned and engaged with an upper shoulder of a second molded plastic member.

30. A device as recited in claim 29 in which said plastic member has a thickness in the range from 1½ to 3 inches.

31. A device as recited in claim 29 in which said plastic member is comprised of recycled plastic.

32. A device as recited in claim 29 and further including a molded plastic wedge member having a thickness dimension that slopes uniformly across the length dimension thereof from a first height dimension to a second height dimension, said wedge member dimensioned to rest atop said open top surface of said cone and directly beneath said web of said molded plastic member.

33. A device as recited in claim 29 wherein said webs are constructed in a geometric shape selected from the group consisting of: a square, a rectangle, an ellipse, a semi circle, an oval, a cylinder, a triangle, a sphere, and any combination of the above.

34. A device as recited in claim 29 wherein said molded plastic member is a continuous concentric member conforming to the open top surface of the cone.

35. A device as recited in claim 29 wherein said molded plastic member is a segmented concentric member having an interlocking means, such that an aligned and engaged plurality of said segmented concentric members conform to the open top surface of the cone.

36. A device as recited in claim 29 in which said plastic member is further molded in a rectangular plastic member.

* * * * *